US010913306B2

(12) United States Patent
Levand

(10) Patent No.: US 10,913,306 B2
(45) **Date of Patent: *Feb. 9, 2021**

(54) SWIVEL PREP TOOL

(71) Applicant: THE SHERWIN-WILLIAMS COMPANY, Cleveland, OH (US)

(72) Inventor: Victor J. Levand, Warrensville Hts., OH (US)

(73) Assignee: SWIMC LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/419,412

(22) Filed: May 22, 2019

(65) Prior Publication Data

US 2019/0270334 A1 Sep. 5, 2019

Related U.S. Application Data

(63) Continuation of application No. 15/061,377, filed on Mar. 4, 2016, now Pat. No. 10,343,449.

(60) Provisional application No. 62/129,495, filed on Mar. 6, 2015.

(51) Int. Cl.

| | |
|---|---|
| ***B44D 3/16*** | (2006.01) |
| ***B25F 1/02*** | (2006.01) |
| ***B25G 1/10*** | (2006.01) |
| *A47L 13/022* | (2006.01) |
| *B05C 17/02* | (2006.01) |

(52) U.S. Cl.

CPC ..... *B44D 3/164* (2013.01); *B25F 1/02* (2013.01); *B25G 1/10* (2013.01); *A47L 13/022* (2013.01); *B05C 17/0245* (2013.01)

(58) Field of Classification Search

CPC ..... B44D 3/164; A47L 13/022; B26B 1/04

See application file for complete search history.

(56) References Cited

U.S. PATENT DOCUMENTS

| | | | |
|---|---|---|---|
| 98,949 | A | 1/1870 | Gerelds |
| 929,194 | A | 7/1909 | Compton |
| 3,568,315 | A | 3/1971 | Smith |
| 3,942,249 | A | 3/1976 | Poehlmann |
| 3,958,330 | A | 5/1976 | Hutchens |
| 4,087,911 | A | 5/1978 | Schrock et al. |
| 4,265,017 | A | 5/1981 | Collins |
| D267,104 | S | 11/1982 | Loveless |
| 4,470,327 | A | 9/1984 | Gerber, Jr. et al. |
| 4,495,698 | A | 1/1985 | Gerber, Jr. |
| 4,541,556 | A | 9/1985 | Collins |

(Continued)

*Primary Examiner* — Michael D Jennings

(74) *Attorney, Agent, or Firm* — Tucker Ellis, LLP; Carlos Garritano; Patrick Clunk

(57) ABSTRACT

Provide is a tool that includes a handle assembly including a top and bottom portion and a blade disposed between the top and bottom portion having first and second ends and an opening at its first end. The opening includes first and second notches opposed to one another. The tool also includes a latch assembly disposed between the top and bottom portion that is movable between first and second positions, the latch assembly including a latch having a protrusion that engages one of the first or second notches in the first position and disengages from the one of the first or second notches in the second position. The blade is rotatable about the first end between a closed positioned where the first notch is engaged by the protrusion, and an open position where the second notch is engaged by the protrusion.

16 Claims, 11 Drawing Sheets

(56) References Cited

U.S. PATENT DOCUMENTS 4,547,937 A 10/1985 Collins
4,558,516 A 12/1985 Collins
D291,626 S 9/1987 Collins
D291,627 S 9/1987 Collins
D294,083 S 2/1988 Collins
D294,199 S 2/1988 Collins
4,805,819 A 2/1989 Collins
5,107,593 A * 4/1992 Hutchins ..... B44D 3/164 30/169
5,111,581 A 5/1992 Collins
5,251,352 A 10/1993 Cullison
D345,289 S 3/1994 Sakai
D347,374 S 5/1994 Sakai
D347,375 S 5/1994 Sakai
D348,599 S 7/1994 Sakai
D356,723 S 3/1995 Sakai
5,450,670 A 9/1995 Sakai
D367,599 S 3/1996 Sakai
D399,621 S 10/1998 Henke
5,822,867 A 10/1998 Sakai
5,887,347 A 3/1999 Gibbs
5,956,788 A 9/1999 Henke
5,964,035 A * 10/1999 Poehlmann ..... B26B 1/046 30/155
5,979,058 A 11/1999 Henke et al.
6,826,836 B1 12/2004 Lin
6,836,967 B1 1/2005 Sakai
7,146,736 B1 * 12/2006 Collins ..... B26B 1/042 30/160
7,246,441 B1 * 7/2007 Collins ..... B26B 1/042 30/159
8,291,597 B2 10/2012 Hawk et al.
8,296,958 B1 * 10/2012 Frazer ..... B26B 1/042 30/155
8,464,382 B2 6/2013 Chu
8,490,288 B1 7/2013 Mollick et al.
8,832,943 B2 9/2014 Sakai
2004/0154169 A1 * 8/2004 McCann ..... B26B 1/048 30/161
2006/0059694 A1 * 3/2006 Carter, III ..... B26B 1/044 30/159
2006/0200996 A1 * 9/2006 Pearman ..... B26B 1/04 30/158
2006/0230620 A1 * 10/2006 Steigerwalt ..... B26B 1/02 30/159
2006/0260138 A1 * 11/2006 VanHoy ..... B26B 1/044 30/161
2007/0214652 A1 * 9/2007 Ping ..... B26B 1/042 30/161
2010/0192381 A1 8/2010 Sakai
2011/0107603 A1 5/2011 Giuntoli et al.
2012/0023753 A1 * 2/2012 Wen ..... B26B 5/00 30/156
2012/0144678 A1 * 6/2012 Chen ..... B26B 1/046 30/161
2013/0227994 A1 9/2013 Wang
2014/0047718 A1 * 2/2014 Fellows ..... B26B 1/04 30/161
2014/0115899 A1 * 5/2014 Frazer ..... B26B 1/048 30/160

* cited by examiner

SWIVEL PREP TOOL

RELATED APPLICATION

This application is a continuation application and claims priority to and the benefit of U.S. application Ser. No. 15/061,377 filed on Mar. 4, 2016. U.S. application Ser. No. 15/061,377 claims priority to and the benefit of U.S. Provisional Application Ser. No. 62/129,495 filed Mar. 6, 2015. The entireties of which are incorporated herein by reference.

BACKGROUND

Painters and drywallers use a variety of tools to perform a variety of tasks while painting and drywalling. Switching between the various tools wastes time and added space is required to store such tools. To save time and space, a single tool can be provided for painters and drywallers that enables the painter/drywaller to perform the variety of tasks. For example, a single tool can be provided for cleaning a paint roller, scraping paint, cleaning cracks, working putty, and opening paint cans.

TECHNICAL FIELD

Embodiments of the subject matter disclosed herein relate to a tool, and more particularly a folding tool that swivels.

BRIEF DESCRIPTION

In an embodiment, a tool is provided that includes a handle assembly including a top and bottom portion and a blade disposed between the top and bottom portion having first and second ends and an opening at its first end. The opening includes first and second notches opposed to one another. The tool also includes a latch assembly disposed between the top and bottom portion that is movable between first and second positions, the latch assembly including a latch having a protrusion that engages one of the first or second notches in the first position and disengages from the one of the first or second notches in the second position. The blade is rotatable about the first end between a closed positioned where the second end of the blade is disposed between the handle portions and the first notch is engaged by the protrusion, and an open position where the second end of the blade is outside the handle portions and the second notch is engaged by the protrusion.

BRIEF DESCRIPTION OF THE DRAWINGS

Reference is made to the accompanying drawings in which particular embodiments and further benefits of the provided subject matter are illustrated as described in more detail in the description below.

DETAILED DESCRIPTION

Figure 1:
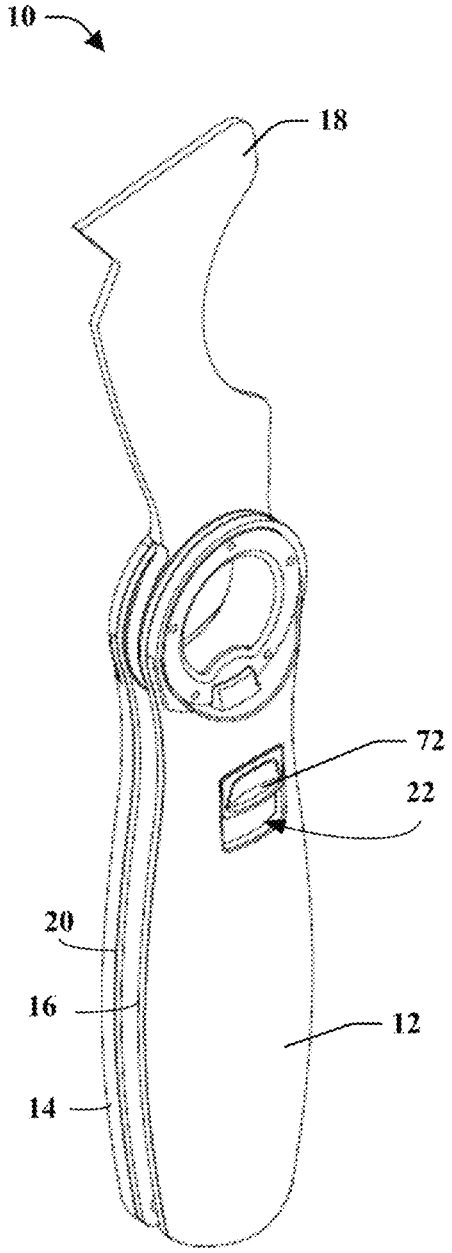
FIG. 1 is a top front perspective view of a tool in an open position.
Figure 2:
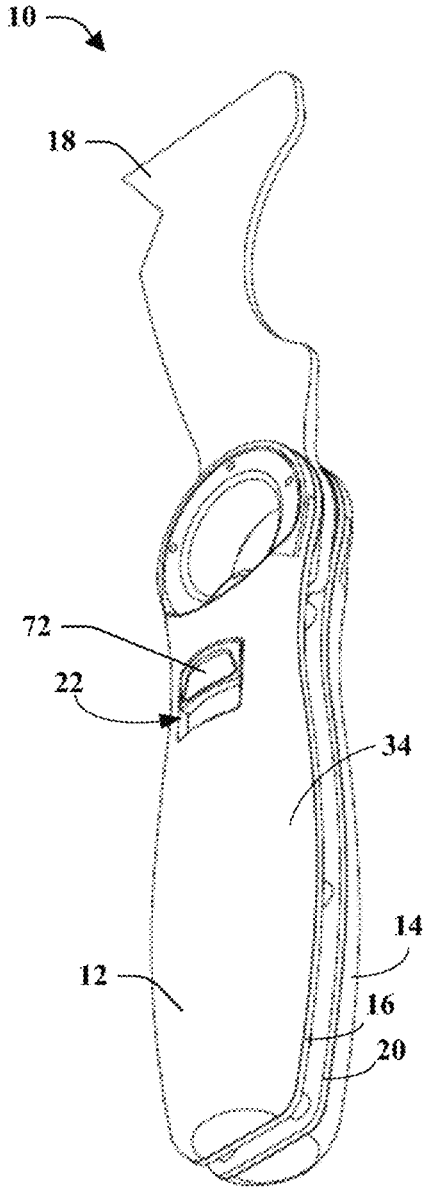
FIG. 2 is a bottom front perspective view of the tool in an open position.
Figure 3:
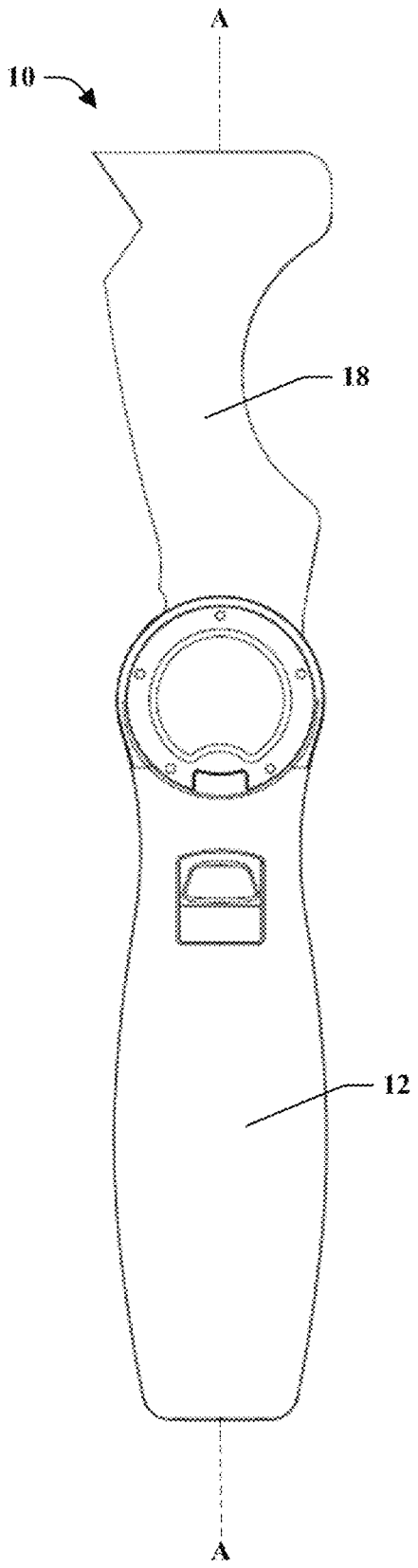
FIG. 3 is front view of the tool in an open position.
Figure 4:
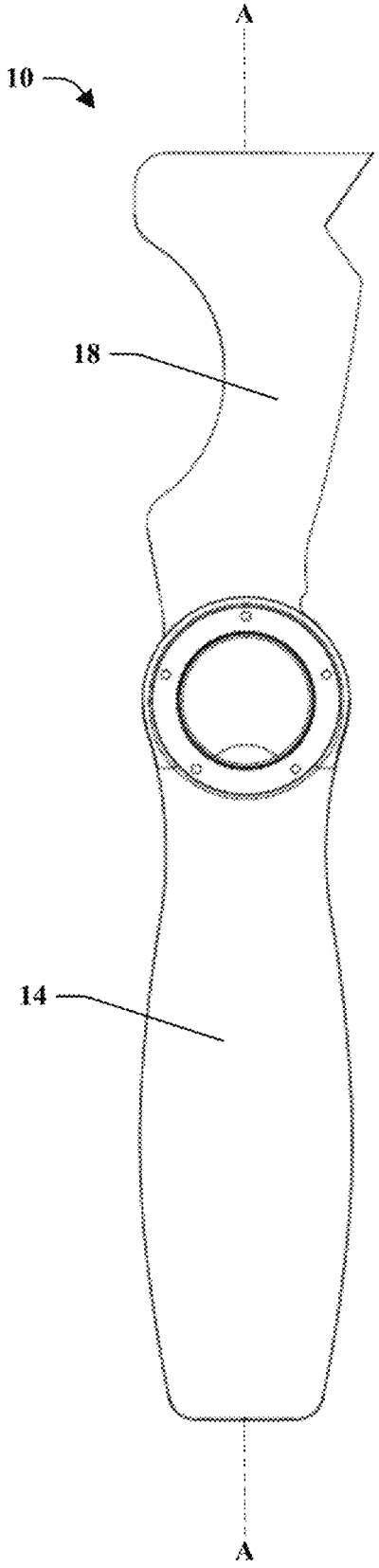
FIG. 4 is a rear view of the tool in an open position.
Figure 5:
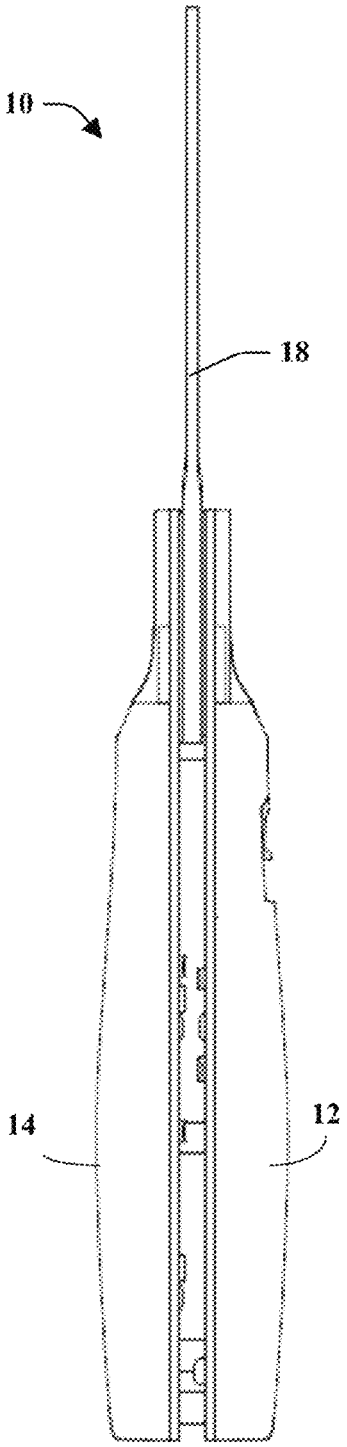
FIG. 5 is a left side view of the tool in an open position.
Figure 6:
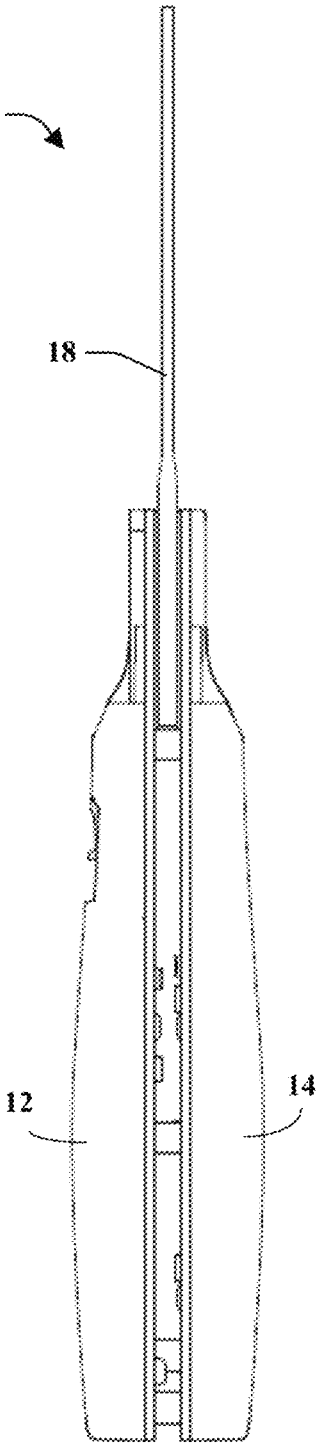
FIG. 6 is a right side view of the tool in an open position.
Figure 7:
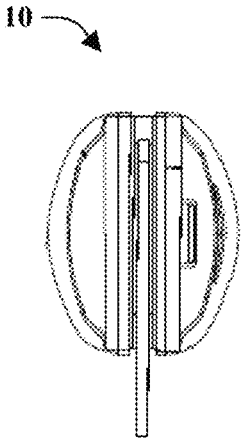
FIG. 7 is a top view of the tool in an open position.
Figure 8:
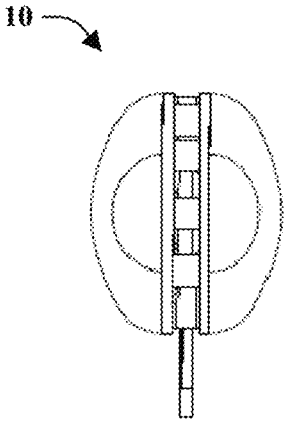
FIG. 8 is a bottom view of the tool in an open position.
Figure 9:
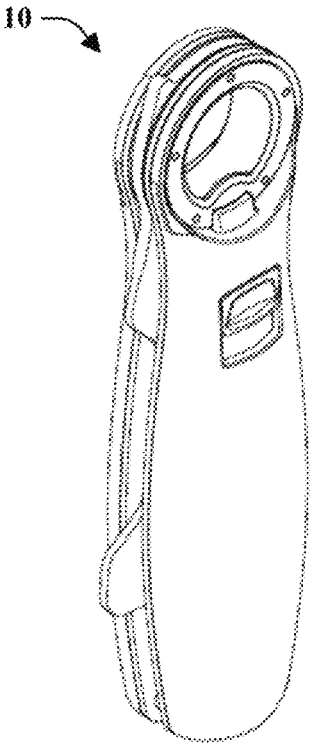
FIG. 9 is a top front perspective view of a tool in a closed position.
Figure 10:
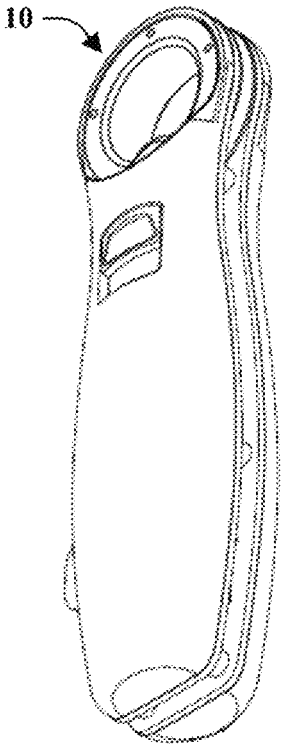
FIG. 10 is a bottom rear perspective view of the tool in a closed position.
Figure 11:
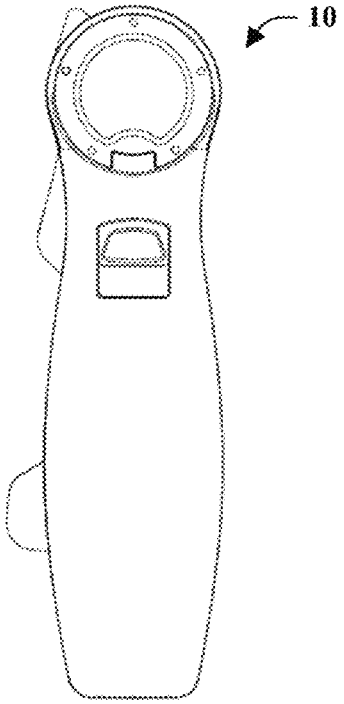
FIG. 11 is front view of the tool in a closed position.
Figure 12:
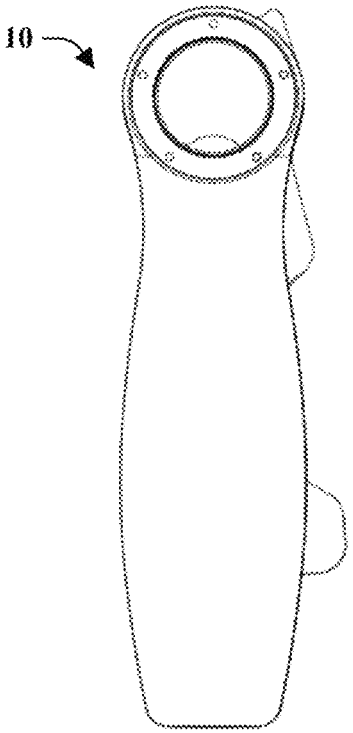
FIG. 12 is a rear view of the tool in a closed position.
Figure 13:
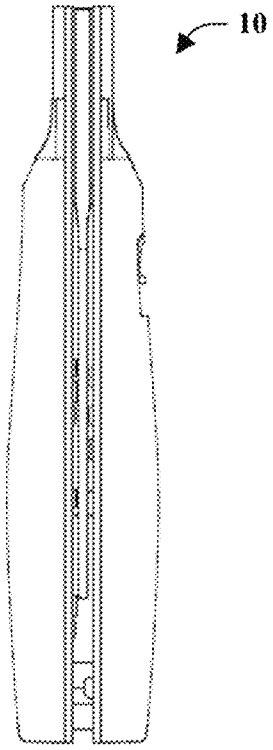
FIG. 13 is a left side view of the tool in a closed position.
Figure 14:
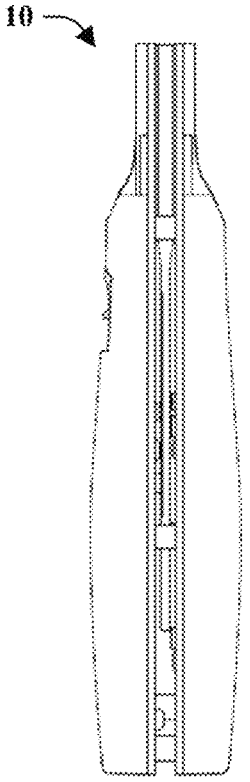
FIG. 14 is a right side view of the tool in a closed position.
Figure 15:
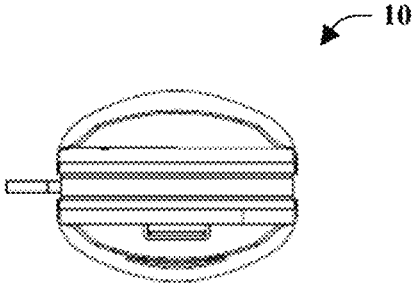
FIG. 15 is a top view of the tool in a closed position.
Figure 16:
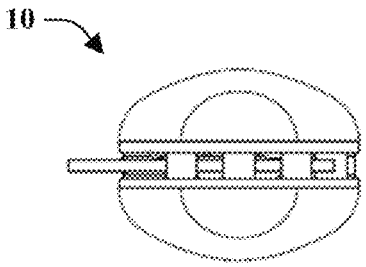
FIG. 16 is a bottom view of the tool in a closed position

Embodiments of the provided subject matter relate to a tool having a handle with a top portion and a bottom portion opposite thereto in which an opening in a shape is included on each portion. The opening can be a circle-shaped opening about which a blade rotates between an open position and a closed position. The tool can include a latch assembly moveable between a first position and a second position. In the first position a latch of the latch assembly can restrict movement of the blade to position the blade in the open position or the closed position. In the second position the latch can allow the blade to move between the open position and the closed position. The latch can engage one or more notches on the blade and each of the one or more notches can correspond to a position of the blade.

With reference to the drawings, like reference numerals designate identical or corresponding parts throughout the several views. However, the inclusion of like elements in different views does not mean a given embodiment necessarily includes such elements or that all embodiments of the invention include such elements.

Referring to FIGS. 1-16, a tool, such as a swivel prep tool is illustrated at reference numeral 10. The tool 10 can be used during painting and drywalling, for example, to scrape paint, spread compound, clean rollers, remove putty, open a paint lid, open cracks, etc. The tool includes a longitudinal axis A-A and a handle assembly including two outer portions, a top portion 12 and a bottom portion 14. Sandwiched between the top and bottom portions 12 and 14 are a top plate 16, a blade 18, and a bottom plate 20. In an embodiment, the top plate 16 is coupled to at least one of the first portion 12 or the bottom plate 20. In an embodiment, the bottom plate 20 is coupled to at least one of the bottom portion 14 or the top plate 16. By way of example and not limitation, the coupling between the top portion 12, bottom portion 14, top plate 16, bottom plate 20, among others can be a screw, a bolt and nut, a rivet, a male and female coupling of elements, among others.

The tool 10 also includes a latch assembly 22 that prevents movement of the blade 18 from a closed position or an open position when the latch assembly 22 is in a first position and allows movement of the blade from the closed position or the open position to the other of the closed position or open position when the latch assembly 22 is in a second position. The blade 18 is shown in the open position in FIGS. 1-8 and in the closed position in FIGS. 9-16.

Figure 17:
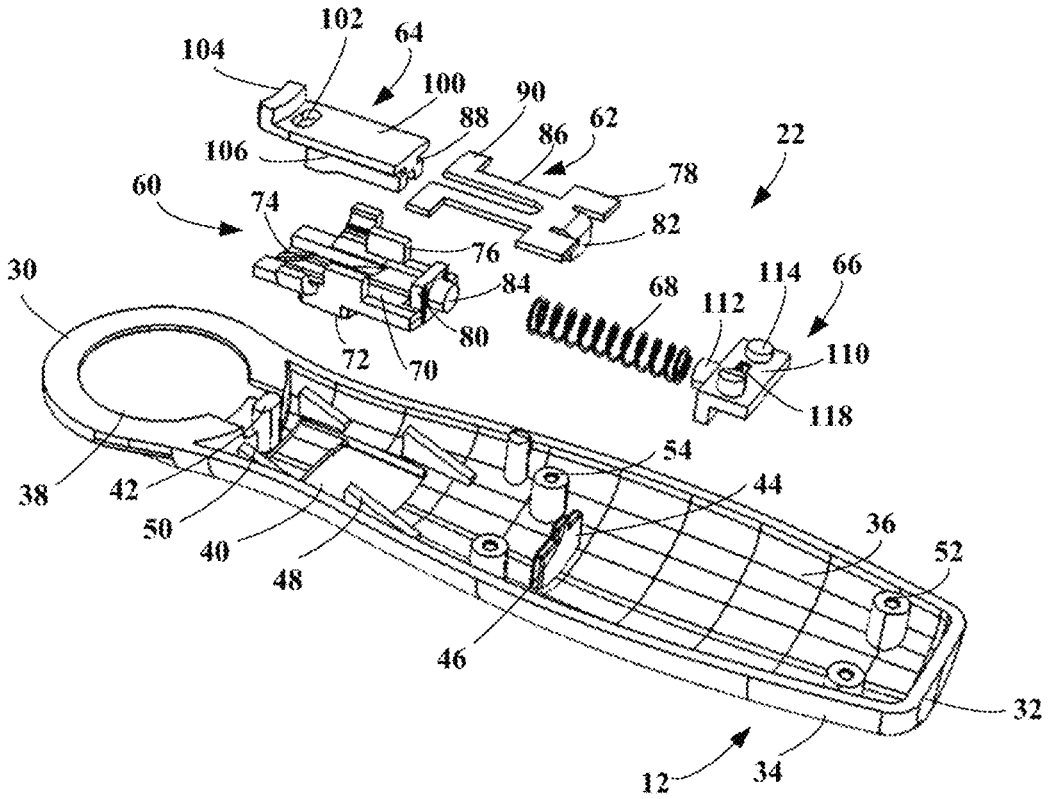
FIG. 17 is an exploded view of a top portion and a latch assembly of the tool.

Referring now to FIG. 17 and the top portion 12 in detail, the top portion 12 of the handle assembly has first and second ends 30 and 32 spaced along the axis, an outer surface 34, and an inner surface 36. The top portion 12 includes a first opening 38 at the first end 30 and a second opening 40 longitudinally spaced from the first opening 38. The top portion 12 also includes a guide pin 42 projecting from the inner surface 36 perpendicular to the longitudinal axis between the openings 38 and 40, and a spring footing protrusion 44 projecting from the inner surface 36 perpendicular to the longitudinal axis between the second opening 40 and the second end 32. The spring footing protrusion 44 may include a projecting portion 46 projecting upward from the spring footing protrusion 44. The top portion 12 further includes a first pair of ramps 48 and a second pair of ramps 50 for guiding the latch assembly 22 and a plurality of pairs of openings 52 and 54 spaced around the inner surface 36 for receiving fasteners to secure the top plate 16 to the top portion 12.

Referring now to FIGS. 17-20 and the latch assembly 22 in detail, the latch assembly 22 (also referred to as a spring-loaded latch assembly or a blade lock assembly) includes a button 60, a slider 62, a latch 64, a spring footing 66, and a resilient member 68, such as a spring having one end seated on the spring footing 66 and another end seated on a bottom of the button 60. The button 60 includes a body 70 having an actuation portion 72 on a front side configured to be contacted by a user and extending through the second opening 40 in the top portion 12, and a seat 74 on a backside that abuts a bottom of the latch 64. The button 60 also includes a pair of first ledges 76 extending from the body 70 that abut legs 78 on the slider 62 to move the slider axially towards the spring footing 66 when the actuation portion 72 is moved axially by the user, and a second ledge 80 extending from the body that abuts a foot 82 on the slider 62 to move the slider axially away from the spring footing 66 when the actuation portion 72 is released. On a backside of the second ledge 80 is a projection 84 that serves as a seat for one end of the spring 68.

Figure 18:
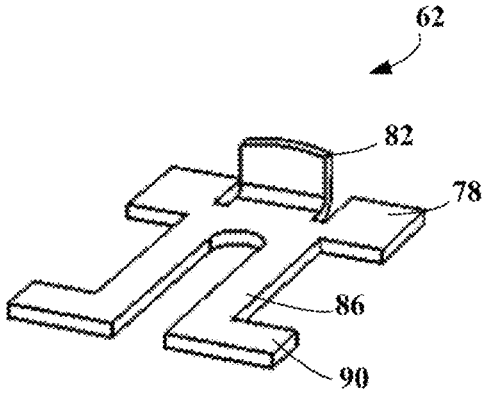
FIG. 18 is a perspective view of a slider of the latch assembly.

As best shown in FIG. 18, the slider 62 includes the legs 78 on either side thereof, the foot 82 in-between the legs 78, a pair of arms 86 extending from the legs/foot configured to move in respective channels 88 in the latch 64, and tabs 90 projecting outward from respective arms 86. The legs 78 are configured to be guided by the first pair of ramps 48 on the top portion 12 and a first pair of ramps 94 on the top plate 16, and the tabs 90 are configured to be guided by the second pair of ramps 50 on the top portion 12 and a second pair of ramps 96 on the top plate 16.

Figure 19:
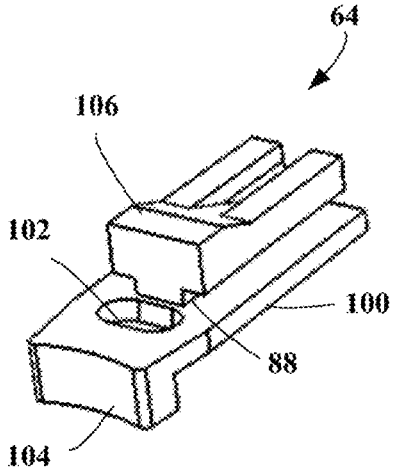
FIG. 19 is a perspective view of a latch of the latch assembly.

As best shown in FIG. 19, the latch 64 includes a body 100 having an opening 102 therethrough for receiving the guide pin 42, a protrusion 104 projecting perpendicular to the longitudinal axis when installed for engaging the blade 18, a guide portion 106 extending from the body 100 that abuts the seat 74, and the channels 88 defined between the body 100 and the guide portion 106.

The spring footing 66 includes a body 110, such as an L-shaped body having a projection 112 that serves as a seat for one end of the spring 68, a pair of projections 114 that are received in openings 116 in the top plate 16, and an opening 118 through which the projecting portion 46 of the spring footing protrusion 44 extends.

Figure 20:
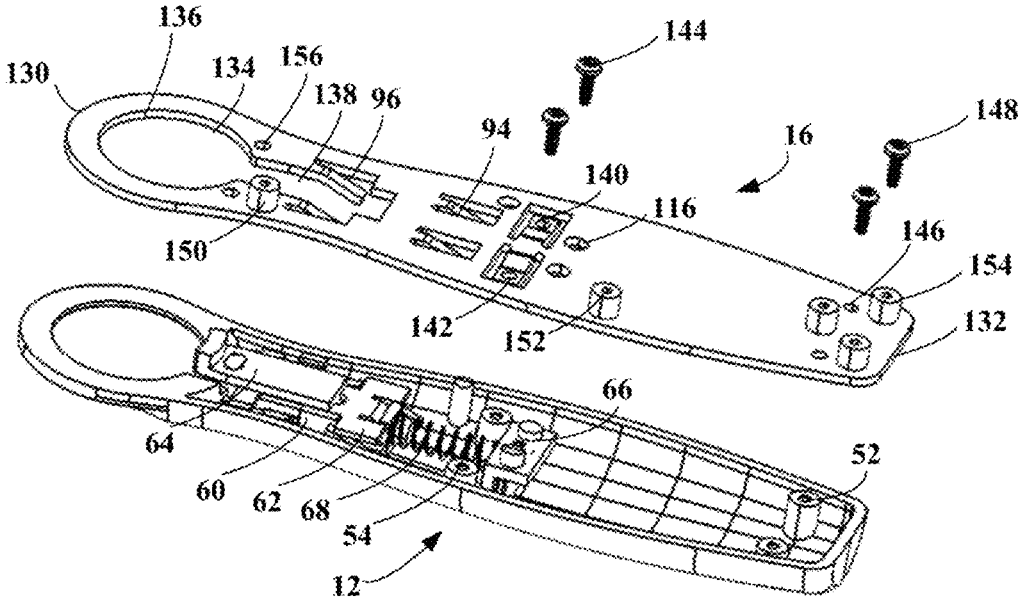
FIG. 20 is a partial exploded view of the top portion, the latch assembly, and a top plate of the tool.
Figure 21:
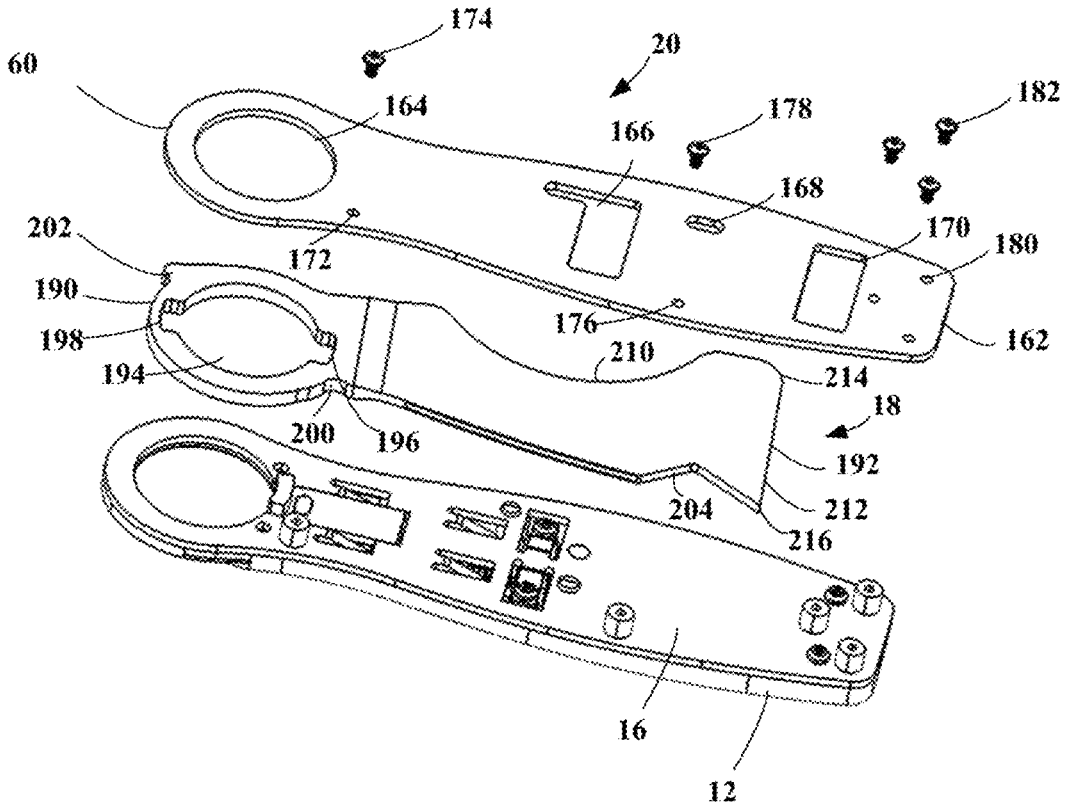
FIG. 21 is a partial exploded view of the top portion, the latch assembly, the top plate, a blade, and a bottom plate of the tool.

Turning now to FIG. 20, the latch assembly 22 is shown installed in the top portion 12 and the top plate 16 is shown. The top plate 16 includes the first and second pairs of ramps 94 and 96 for guiding the latch assembly 22, and in particular for guiding the slider 62, and the openings 116 for receiving the projections 114 of the spring footing 66. The top plate 16 also includes first and second ends 130 and 132 spaced along the axis and an opening 134 at the first end 130. The opening 134 has a first portion 136 that aligns with the opening 38 in the top portion 12 and a second portion 138 that surrounds the latch 64 as shown in FIG. 21. The top plate further includes recessed openings 140 on arms 142 for receiving fasteners 144 that are then received in the openings 54 in the top portion 12, openings 146 for receiving fasteners 148 that are then received in the openings 52 in the top portion 12 to secure the top plate 16 to the top portion 12, and openings 156 for receiving positioning pins of a keyed washer.

Secured to the top plate 16 are spacers 150, 152, and 154. The spacer 150 is secured to the top plate 16 via a fastener received in an opening in the top plate 16 near the first end 130. The spacer 150 serves as a stop for the blade 18 both when the blade is in the closed position and the open position. The spacer 152 is secured to the top plate 16 via a fastener received in an opening in the top plate 16 near the openings 116. The spacer 152 serves as a stop for a portion of the blade 18 when the blade is in the closed position. The spacer 154, and as shown plurality of spacers 154, are secured to the top plate 16 via respective fasteners received in respective openings in the top plate 16 near the second end 132.

Turning now to FIG. 21, the top plate 16 is shown secured to the top portion 12 and the blade 18 and bottom plate 20 are shown. The bottom plate 20 includes first and second ends 160 and 162 spaced along the axis and an opening 164 at the first end 160 that aligns with the openings 38 and 136. The bottom plate 20 also includes openings 166, 168 and 170 for aligning with and securing the bottom plate 20 to the bottom portion 14 as discussed below. The bottom plate further includes opening 172 that receives fastener 174 that is then received in the spacer 152, opening 176 that receives fastener 178 that is then received in the spacer 154, and openings 180 that receive fasteners 182 that are then received in spacers 154 to secure the bottom plate 20 to the top plate 16.

The blade 18, which may be any suitable shape made of any suitable material such as metal, includes first and second ends 190 and 192 spaced along the axis and an opening 194 at the first end 190 that aligns with the openings 38, 136, and 164. The blade 18 also includes first and second notches 196 and 198 in the opening 194 opposite one another and aligned with the axis. The first notch 196 engages the protrusion 104 on the latch 64 when in the closed position and the latch 64 is in the first position and the second notch 198 engages the protrusion 104 when in the open position and the latch 64 is in the first position. When in the closed position, the second end 192 of the blade is encased within the handle assembly and in the open position, the second end 192 of the blade is exposed outside the handle assembly. It will be appreciated that one or more additional notches may be provided in the opening 194, such as a notch between the first and second notches 196 and 198, which can allow the blade to be locked or positioned at a location in-between the open position and closed position.

Figure 25:
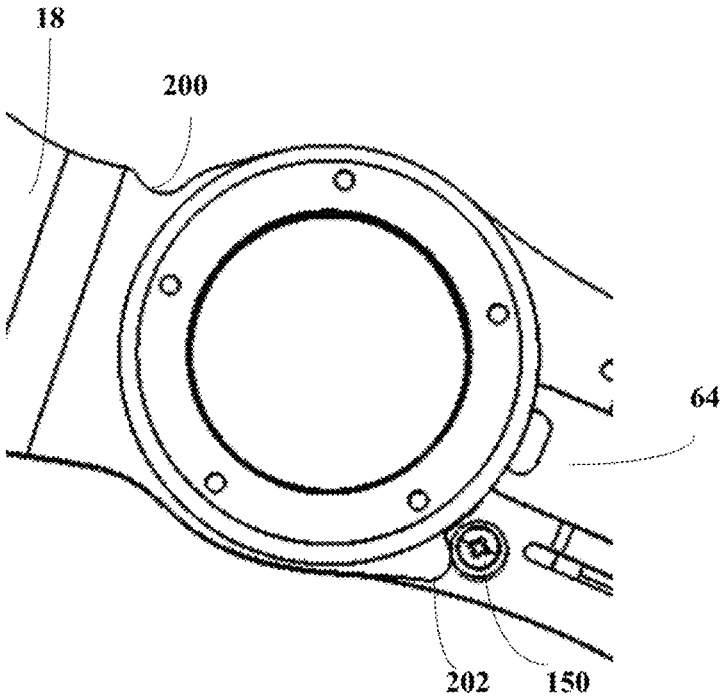
FIG. 25 is a partial perspective view of the tool with the back plate and back portion removed with the blade in the open position.
Figure 26:
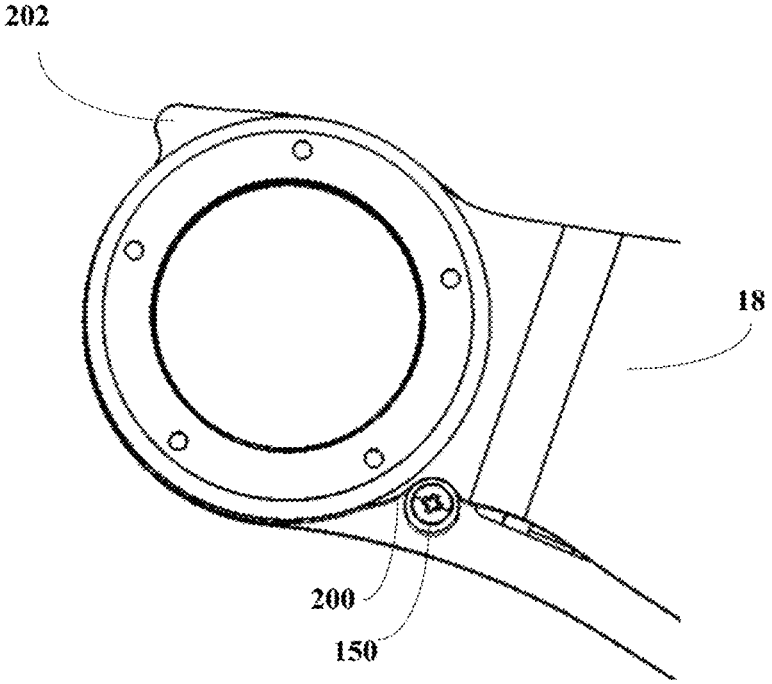
FIG. 26 is a partial perspective view of the tool with the back plate and back portion removed with the blade in the closed position.

The blade 18 additionally includes a groove 200 on an outer surface thereof that engages the spacer 150 in the closed position as shown in FIG. 26, a projecting portion 202 at the first end 190 having a groove that engages the spacer 150 in the open position as shown in FIG. 25, and a portion 204 on an outer surface thereof that engages the spacer 152 in the closed position. The spacer 150 prevents over rotation of the blade 18 if the protrusion 104 is in the second position. In the illustrated embodiment, the blade 18 includes a concave edge surface 210 for cleaning, a top edge 212 at the second end 192 for scraping and/or applying a material, and a curved edge 214 and a pointed edge 216 for enlarging/opening cracks and/or cutting.

Figure 22:
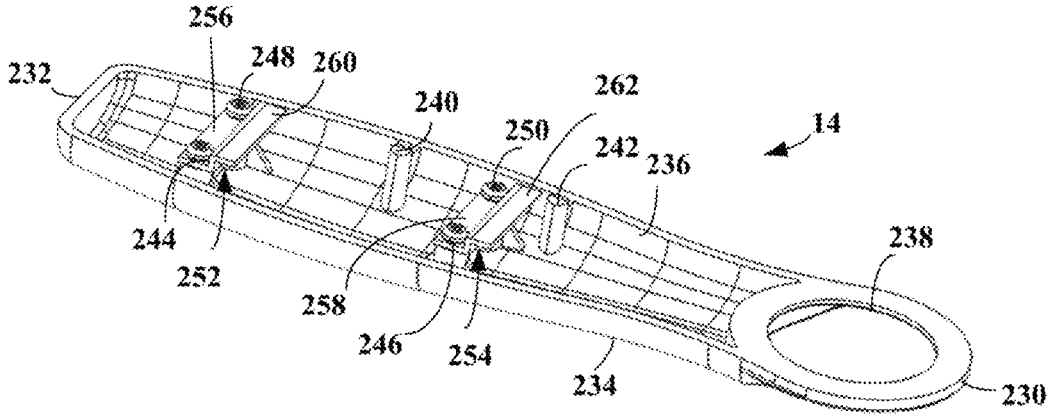
FIG. 22 is a perspective view of a bottom portion of the tool.
Figure 23:
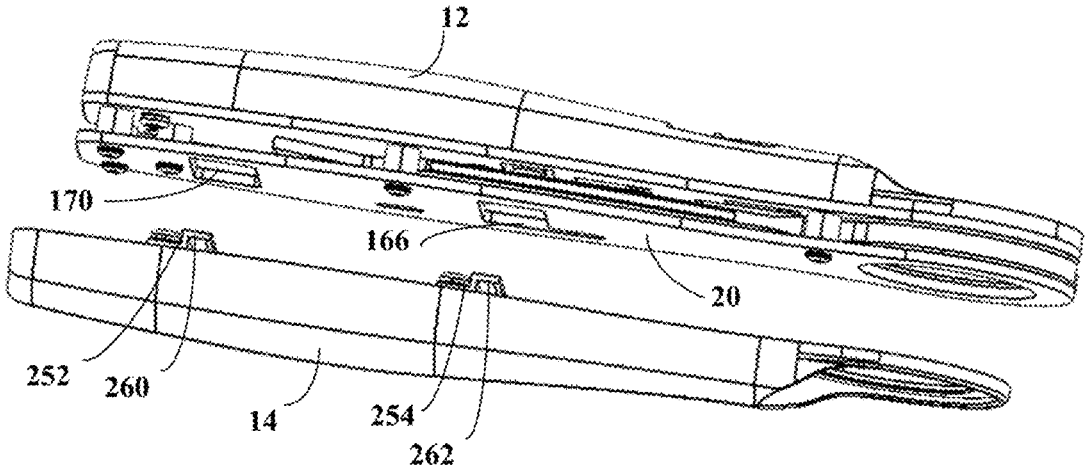
FIG. 23 is a view of the bottom portion being attached to the bottom plate.

Turning now to FIGS. 22 and 23 and the bottom portion 14 in detail, the bottom portion 14 has first and second ends 230 and 232 spaced along the axis, an outer surface 234, and an inner surface 236. The bottom portion includes an opening 238 at the first end 230 that aligns with the openings 38, 136, 164, and 194, a pair of guide pins 240 and 242 projecting from the inner surface 236 perpendicular to the longitudinal axis, and pairs of openings 244 and 246 for receiving respective fasteners 248 and 250 that secure hooks 252 and 254 to the openings 244 and 246 respectively.

The hooks 252 and 254 may be substantially Z-shaped with portions 256 and 258 that abut the respective openings 244 and 246 and portions 260 and 262 that abut the bottom plate 20. As shown in FIG. 23, to connect the bottom portion 14 to the bottom plate 20, the portion 260 of the hook 252 is inserted into the opening 170 and the portion 262 of the hook 254 is inserted into the opening 166, thereby causing the guide pin 240 to be received in the opening 168 and the guide pin 242 to be received in a portion of the opening 166. The bottom portion 14 is then advanced towards the first end 160 of the bottom plate 20 causing the portions 260 and 262 to abut the bottom plate 20 and the guide pins 240 and 242 to abut ends of the openings 168 and 166.

Figure 24:
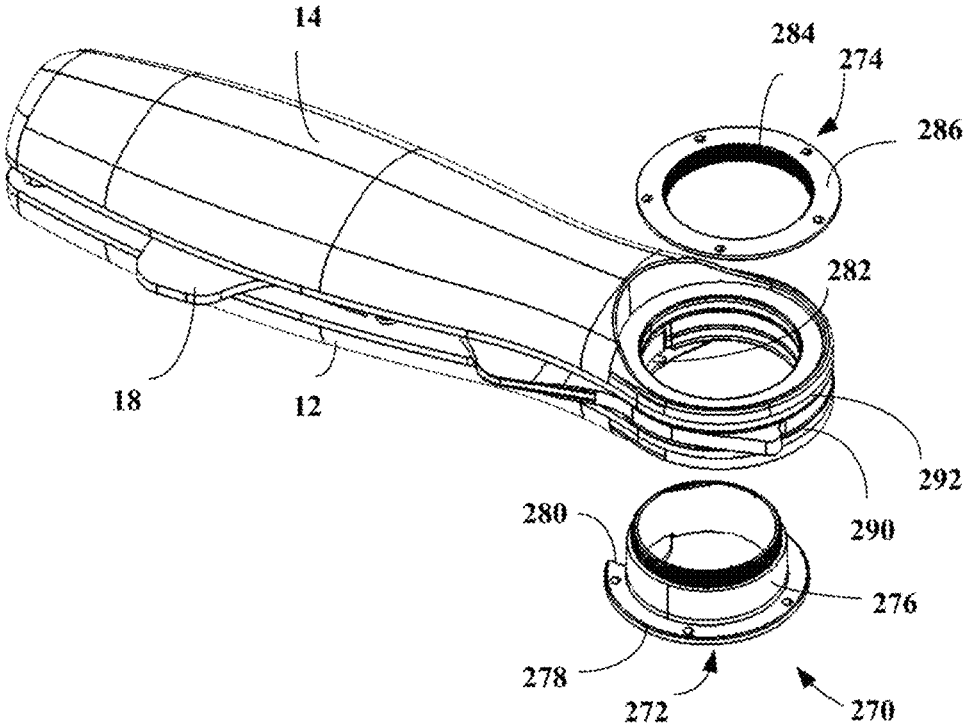
FIG. 24 is a perspective view of the tool with a collar assembly removed.

Turning now to FIG. 24, after the top portion 12, bottom portion 14, top plate 16, bottom plate 20, and blade 18 have be connected, a collar assembly 270 is coupled thereto. The collar assembly 270 includes a collar top 272 and a collar bottom 274 configured to be coupled together in any suitable manner, such as by a threaded connection. The collar top 272 includes a body 276 defining an opening, a flange 278, and a slot 280 in the flange 278 for receiving a tab 282 of the top portion 14, and the collar bottom includes a body 284 defining an opening and a flange 286. The body 276 extends through or into the openings 38, 136, 164, 194, and 238 and the flange 278 abuts the outer surface 34 of the top portion 12 around the opening 38. The body 284 extends through or into at least the opening 238 of the bottom portion 14 and the flange 286 abuts the outer surface 234 of the bottom portion 14 around the opening 238. The body 276 can include threads on an outer surface that mate with threads on an inner surface of the body 284 such that the collar bottom 274 can be rotated relative to the collar top 272 to couple the collar top and bottom together. It will be appreciated that while the openings 38, 136, 164, 194, and 238 and the openings in the collar top and bottom 272 and 274 are shown as substantially circular, the openings can be any suitable shape, such as an oval, a square, a rectangle, a triangle, an ellipse, oblong, etc.

Figure 27:
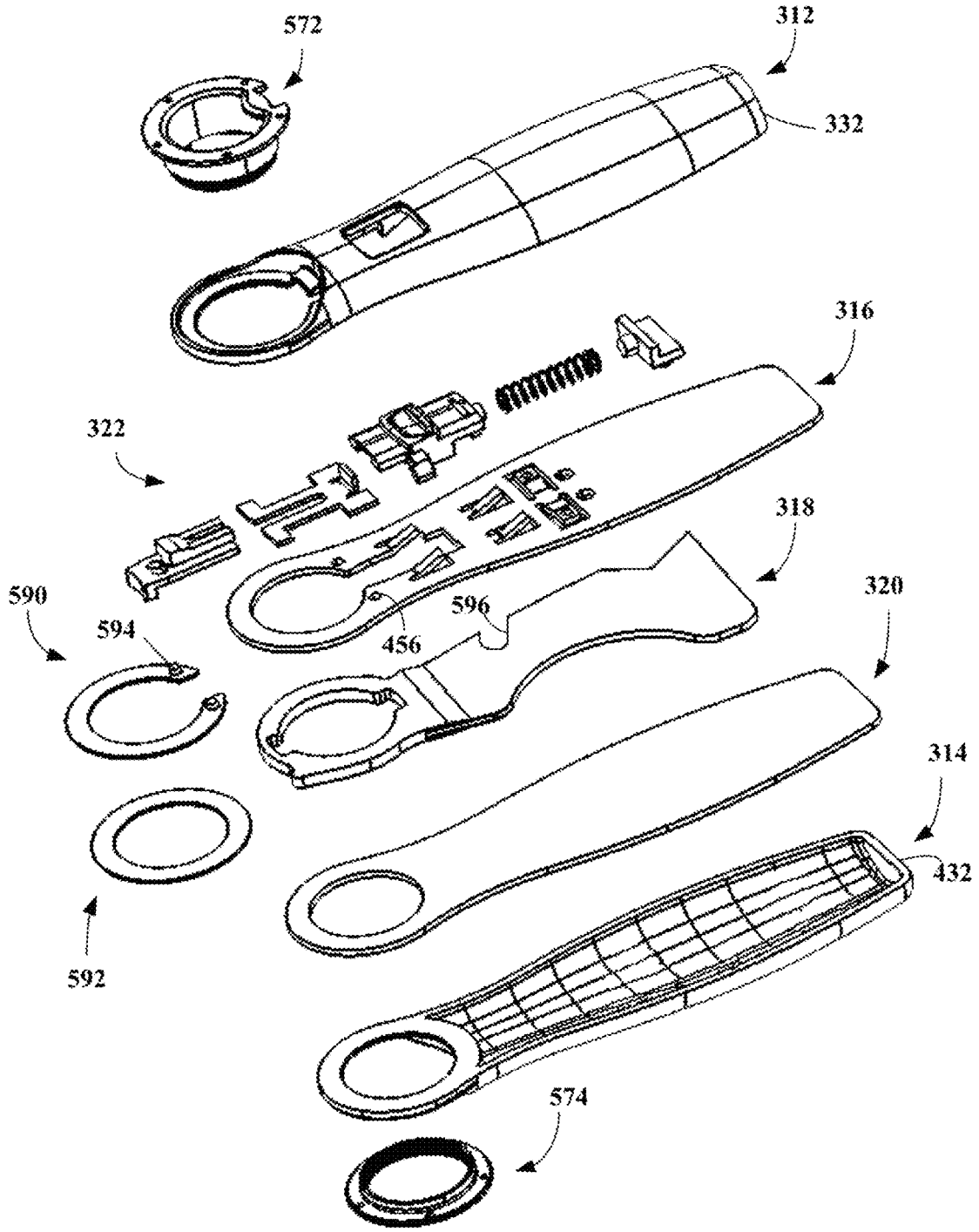
FIG. 27 is an exploded view of another embodiment of the tool.

The tool may also include one or more washers, and in the illustrated embodiment a keyed washer 290 and a flat washer 292 similar to the washers shown in FIG. 27. The keyed washer 290 can be provided between the top plate 16 and the blade 18, and the flat washer can be provided between the blade 18 and the bottom plate 20. The washers 290 and 292 are held in position by the collar assembly 270. The washers may be any suitable washer, such as a nylon or other suitable friction washer.

During use of the tool, to move the blade 18 from the closed position to the open position, the user moves the latch assembly 22 from the first position to the second position thereby moving the actuation portion 72 of the button 60 axially towards the second end 32 of the top portion 12. The axial movement compresses the spring 68, moves the slider 62 axially towards the second end 32, and causes the slider to be angled by the ramps 48, 50, 94 and 96 such that the arms 86 and tabs 90 move in a front direction towards the actuation portion 72. The arms 86 remain in the channels 88 of the latch 64 during movement such that the end of the latch 64 opposite the protrusion 64 is moved in a back direction towards the back portion 14 causing the protrusion 104 to move in the front direction to disengage from the notch 196. The motion is an elevator like motion or perpendicular axial motion relative to the axial orientation of the blade.

The blade 18 can then be swiveled or rotated about an axis perpendicular the longitudinal axis to the open position. The user can release the actuation portion 72 either after the notch 196 has been moved past the protrusion 104 or once the notch 198 is aligned with the protrusion 104. When the actuation portion 72 is released, the spring 68 moves the actuation button 60 and slider 62 axially towards the first end 30 and the ramps 48, 50, 94, and 96 guide the slider 62 back to its position substantially perpendicular to the longitudinal axis. The movement causes the arms 86 to move through the channels 88 and allows the end of the latch 64 to move back to its position substantially perpendicular to the longitudinal axis, thereby moving the protrusion 104 in the back direction to engage the notch 198. When the blade 18 is in the open position, the groove of the projecting portion 202 abuts the spacer 150 as shown in FIG. 25. The same process can be repeated to disengage the notch 198 from the latch 64 and move the blade 18 from the open position to the closed position.

Turning now to FIG. 27, an exemplary embodiment of the tool is shown at 310. The tool 310 is substantially the same as the above-referenced tool 10, and consequently the same reference numerals but indexed by 300 are used to denote structures corresponding to similar structures in the tools. In addition, the foregoing description of the tool 10 is equally applicable to the tool 310 except as noted below.

The tool 310 includes a top portion 312, a bottom portion 314, a top plate 316, a blade 318, a bottom portion 320, a latch assembly 322, a collar top 572, a collar bottom 574, a keyed washer 590, and a flat washer 592. The top plate 316 includes openings 456 that receive positioning pins 594 of the keyed washer to position the keyed washer relative to the top plate 316. In the illustrated embodiment, the top portion 312 and top plate 316 are free of openings at their second ends 332 and 432 for connecting the top portion and top plate together at the second ends 332 and 432. Similarly, the bottom plate 320 is free of openings for connecting to the top plate 316, and the bottom portion 314 and bottom plate 320 are free of openings for connecting to one another. The blade 318 can include additional edges, such as an opener edge 596.

The blade 18 or 318 can include an edge, wherein the edge can be, but is not limited to being, a scraping edge, a beveled edge, a cutting edge, among others. The blade can further include one or more edges. In another embodiment, the blade can be a shape having one or more edges, angles, curves, and the like to provide functionality. For instance, the blade can include one or more edges for scraping, removing of material (e.g., putty), cleaning (e.g., coating roller cleaning, paint roller cleaning, roller cleaning, etc.), enlarging or opening cracks (e.g., opening or enlarging cracks for patching, repair, touch-ups, etc.), applying a material (e.g., applying putty, etc.), among others.

In an embodiment, the tool 10 or 310 can include a hammerhead on the bottom end, a film gauge device that is retractable or removable from the bottom end, a slot for receiving screw driver and/or other bit attachments, and/or an opener on the opening.

The aforementioned elements (e.g., tool 10, top portion 12, bottom portion 14, top plate 16, blade 18, bottom plate 20, latch assembly 22, among others), and the like have been described with respect to interaction between several components and/or elements. It should be appreciated that such elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the subject matter, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A tool including:

a handle assembly including a top portion having first and second ends and a bottom portion having first and second ends, each portion having an opening at its first end;

a blade disposed between the top and bottom portion and having first and second ends and an opening at its first end, the opening including first and second notches opposed to one another that extend radially outward from the opening; and a latch assembly disposed between the top and bottom portion and being movable between first and second positions, the latch assembly engages one of the first or second notches in the first position and disengages from the one of the first or second notches in the second position;

wherein a portion of the latch assembly further extends out an opening located on the top portion and interacts the first or second notches, wherein the portion of the latch assembly is biased in the first position, and wherein the blade is rotatable about the first end between a closed position where the second end of the blade is disposed between the top and bottom portions and the first notch is engaged by a portion of the latch assembly, and an open position where the second end of the blade is outside the top and bottom portions and the second notch is engaged by the portion of the latch assembly.

2. The tool according to claim 1, wherein the openings in the top portion, the bottom portion, and the blade are aligned.

3. The tool according to claim 1, wherein the latch assembly is moveable and includes one of a button, a latch, or a slider.

4. The tool according to claim 3, further including a spring footing secured to the top portion and a resilient member having one end seated on the spring footing and another end seated on the button.

5. The tool according to claim 4, wherein the portion of the latch assembly is configured to move the latch to disengage the protrusion of the latch from the one of the first or second notches when the latch assembly is in the second position.

6. The tool according to claim 1, further including a top plate coupled to the top portion and a bottom plate coupled to at least one of the top plate or the bottom portion, which the blade is disposed between the top and bottom plates.

7. The tool according to claim 6, wherein the top portion and the top plate each include a plurality of ramps, wherein a slider includes portions trapped between the ramps of the top portion and the ramps of the bottom portion, and wherein the ramps are configured to move the slider.

8. The tool according to claim 7, wherein the slider includes legs that move within channels in the latch assembly, and wherein the ramps are configured to move the slider in an angled direction causing the arms to move in the channels and move the a portion of the latch assembly in and out of the first and second notches.

9. The tool according to claim 6, wherein the top and bottom plates each have first and second ends and an opening at its first end, wherein the openings in the top and bottom plates are aligned with the openings in the top portion, the bottom portion, and the blade.

10. The tool according to claim 9, further including a collar assembly having a collar top and a collar bottom, wherein the collar top extends through or into the opening in the top portion, the top plate, the blade, the bottom plate and the bottom portion, and the collar bottom extends through or into at least the opening in the bottom portion, and wherein the collar top and collar bottom are coupled to one another.

11. The tool according to claim 10, wherein the collar top includes threads for mating with corresponding threads of the collar bottom within the openings.

12. The tool according to claim 10, wherein the collar top and collar bottom each include a body and a flange, wherein the body of the collar top extends through or into the opening in the top portion, the top plate, the blade, the bottom plate and the bottom portion and the flange abuts an outer surface of the top portion around the opening in the top portion, and wherein the body of the collar bottom extends through or into at least the opening in the bottom portion and the flange abuts an outer surface of the bottom portion around the opening in the bottom portion.

13. The tool according to claim 6, further including a stop attached to the top plate, wherein the stop is configured to prevent over rotation of the blade when the latch assembly is in the second position.

14. A tool including:

a handle including a first side and a second side, wherein the handle includes an opening;

at least one of a top plate coupled to the first side of the handle and including an opening or a bottom plate coupled to the top plate and the second side of the handle and including an opening;

a blade positioned in-between the top plate or the bottom plate and having a first end and a second end opposite thereto, wherein the first end has an edge and the second end includes an opening and having a first notch and a second notch opposite thereto that extend radially outward from the opening, and wherein the blade is rotatable at the second end between a closed position defined as encasing the first end of the blade within the handle and an open position defined as exposing the first end of the blade outside the handle; and a latch positioned on the first side of the handle and movable between a first position and a second position, wherein the first position of the latch enables the latch to engage the first notch for restricting movement of the blade from the closed position or the second notch for restricting movement of the blade from the open position, and the second position of the latch enables the latch to disengage from the first notch or the second notch to allow movement of the blade between the closed position and the open position.

15. The tool according to claim 14, further including a collar positioned through the opening of the handle, the opening of the top plate, the opening of the blade, and the opening of the bottom plate.

16. The tool according to claim 14, wherein the openings in the handle, top plate, bottom plate, and blade are aligned.

* * * * *